US008434321B2

(12) United States Patent
Kim et al.

(10) Patent No.: US 8,434,321 B2
(45) **Date of Patent: *May 7, 2013**

(54) ICE MAKING ASSEMBLY FOR REFRIGERATOR AND METHOD FOR CONTROLLING THE SAME

(75) Inventors: Young Jin Kim, Seoul (KR); Tae Hee Lee, Seoul (KR); Hong Hee Park, Seoul (KR); Ho Youn Lee, Seoul (KR); Joon Hwan Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 532 days.

This patent is subject to a terminal disclaimer.

(21) Appl. No.: 12/379,536

(22) Filed: Feb. 24, 2009

(65) Prior Publication Data

US 2009/0211267 A1 Aug. 27, 2009

(30) Foreign Application Priority Data

Feb. 27, 2008 (KR) ..... 10-2008-0017608
Feb. 27, 2008 (KR) ..... 10-2008-0017609

(51) Int. Cl.
*F25C 1/00* (2006.01)

(52) U.S. Cl.
USPC ..... 62/353; 62/135; 62/139; 62/344; 62/345

(58) Field of Classification Search ..... 62/66, 73, 62/74, 135, 137, 139, 340, 345, 347, 349, 62/351, 353, 354
See application file for complete search history.

(56) References Cited

U.S. PATENT DOCUMENTS

| | | | | |
|---|---|---|---|---|
| 3,318,105 | A * | 5/1967 | Burroughs et al. | 62/71 |
| 3,367,128 | A * | 2/1968 | Taisel Hosoda | 62/137 |
| 3,760,600 | A * | 9/1973 | Matsui et al. | 62/137 |
| 3,783,636 | A * | 1/1974 | Archer | 62/353 |
| 4,923,494 | A * | 5/1990 | Karlovits | 62/73 |
| 5,127,236 | A * | 7/1992 | von Blanquet | 62/135 |
| 5,187,948 | A | 2/1993 | Frohbieter | |
| 6,357,720 | B1 * | 3/2002 | Shapiro et al. | 249/119 |
| 6,658,869 | B1 * | 12/2003 | Thornbrough | 62/137 |
| 6,688,130 | B1 * | 2/2004 | Kim | 62/352 |
| 6,688,131 | B1 * | 2/2004 | Kim et al. | 62/353 |
| 7,143,588 | B2 * | 12/2006 | Cole | 62/74 |
| 7,406,838 | B2 * | 8/2008 | Wang | 62/344 |
| 2004/0025527 | A1 * | 2/2004 | Takahashi et al. | 62/340 |

(Continued)

FOREIGN PATENT DOCUMENTS

EP 0 580 950 2/1994

OTHER PUBLICATIONS

"Multiple-stage water level sensor capable of reducing cost and facilitating work by sensing plural water levels with one water level sensor" by Lee S C, Dewent Information Ltd, 3 pp., year 2005.*

*Primary Examiner* — Cheryl J Tyler
*Assistant Examiner* — Paolo Gonzalez
(74) *Attorney, Agent, or Firm* — McKenna Long & Aldridge LLP

(57) ABSTRACT

An ice making assembly for a refrigerator and a method for controlling the ice making assembly are provided. The ice making assembly and the method of controlling the ice making assembly provides a constant amount of water supply for each ice making cycle regardless of environmental conditions such as the varying water supply pressure of different installation locations. Furthermore, overflowing can be prevented during water supply with the use of a capacitance water level sensor.

20 Claims, 8 Drawing Sheets

U.S. PATENT DOCUMENTS

2005/0097903 A1* 5/2005 Son et al. ..... 62/135
2005/0115266 A1* 6/2005 Lim et al. ..... 62/351
2005/0126202 A1* 6/2005 Shoukyuu et al. ..... 62/351
2006/0201170 A1* 9/2006 Cole ..... 62/135
2007/0137241 A1* 6/2007 Lee et al. ..... 62/340
2008/0155999 A1* 7/2008 Shin et al. ..... 62/73
2008/0156000 A1* 7/2008 Shin et al. ..... 62/73
2008/0156001 A1* 7/2008 Lee et al. ..... 62/74
2008/0156025 A1* 7/2008 Shin et al. ..... 62/349
2009/0049858 A1* 2/2009 Lee et al. ..... 62/349
2010/0205996 A1* 8/2010 Ducharme et al. ..... 62/351

* cited by examiner

ICE MAKING ASSEMBLY FOR REFRIGERATOR AND METHOD FOR CONTROLLING THE SAME

CROSS-REFERENCE TO RELATED APPLICATIONS

The present application claims priority under 35 U.S.C. 119 and 35 U.S.C 365 to Korean Patent Application No. 10-2008-0017608, filed Feb. 27, 2008 and Korean Application No. 10-2008-0017609, filed Feb. 27, 2008, which is hereby incorporated by reference for all purposes as if fully set forth herein.

BACKGROUND

The present disclosure relates to an ice making assembly for a refrigerator and a method for controlling the ice making assembly.

Refrigerators are domestic appliances used for storing foods in a refrigerated or frozen state. Recently, various kinds of refrigerators have been introduced into the market. Examples of recent refrigerators include: a side-by-side type refrigerator in which a refrigerator compartment and a freezer compartment are disposed in the left and right sides; a bottom-freezer type refrigerator in which a refrigerator compartment is disposed above a freezer compartment; and a top-mount type refrigerator in which a refrigerator compartment is disposed under a freezer compartment.

Furthermore, many of recently introduced refrigerators have a structure that allows a user to access food or drink disposed inside a refrigerator compartment through an alternate access point without having to open a primary refrigerator compartment door. A compressor, a condenser, and an expansion member are disposed inside a refrigerator, and an evaporator is disposed on the backside of a refrigerator main body, as refrigeration-cycle components of the refrigerator.

In addition, an ice making assembly can be provided inside the refrigerator. The ice making assembly may be mounted in a freezer compartment, a refrigerator compartment, a freezer compartment door, or a refrigerator compartment door.

To satisfy consumers' increasing demands for transparent ice, much research has been conducted on ice making assemblies that can provide transparent ice.

In an ice making assembly of the related art, an additional water tank is disposed at a predetermined side of a refrigerator and is connected to an ice making tray through a tube to supply water to the ice making tray, or a tap of an external water source is directly connected to the ice making tray through a tube.

SUMMARY

The disclosed embodiments provide an ice making assembly for a refrigerator that can produce transparent ice easily and maintain the amount of water supplied to make ice at a constant level for each ice making cycle, and a method for controlling the ice making assembly.

The disclosed embodiments also provide an ice making assembly for a refrigerator in which a supply of water is automatically interrupted for preventing overflow when the water supplied to an ice making tray reaches a set level, and a method for controlling the ice making assembly.

The disclosed embodiments also provide an ice making assembly for a refrigerator that can maintain the amount of supplied water at a constant level regardless of water pressure variations occurring at the location the ice-making assembly is installed, and a method for controlling the ice making assembly.

The disclosed embodiments also provide an ice making assembly for a refrigerator that can reduce unnecessary power consumption by immediately detecting a water supply error when water is not supplied to an ice making tray due to, for example, malfunctioning of a water supply valve, and a method for controlling the ice making assembly.

The disclosed embodiments provide an ice making assembly for a refrigerator and a method for controlling the ice making assembly as follows.

In one embodiment, there is provided an ice making assembly for a refrigerator, the ice making assembly including: a tray comprising a water supply part and a plurality of ice recesses; a plurality of fins above the tray; a plurality of rods inserted in the ice recesses through the fins and configured to be lifted and titled together with the fins after a freezing operation; and a water level sensor at one of the ice recesses.

In another embodiment, there is provided an ice making assembly for a refrigerator, the ice making assembly including: a tray comprising a water supply part and a plurality of ice recesses; a plurality of fins above the tray; a plurality of rods inserted in the ice recesses through the fins and configured to be lifted and titled together with the fins after a freezing operation; and a water level sensor at one of the ice recesses, wherein the water level senor includes: an earth electrode at a lowermost side; an intermediate level electrode disposed at a position upward from the earth electrode for detecting an intermediate water level; and a full level electrode disposed at a position upward from the intermediate level electrode for detecting a full water level.

In another embodiment, there is provided a method for controlling an ice making assembly of a refrigerator, the method including: disposing a rod vertically at an upper side of a tray in which an ice recess is formed; moving the rod down into the ice recess; supplying water to the ice recess; allowing the water to reach a height at or below which an earth electrode and at least one electrode of a water level sensor are located; and detecting a level of the water by detecting a capacitance variation between the earth electrode and the at least one electrode.

By using the ice making assembly for a refrigerator and the method of controlling the ice making assembly according to the present disclosure, transparent ice can be easily made.

Furthermore, water can be supplied at a constant level for each ice making cycle regardless of water pressure variations at the installed location of the refrigerator. Therefore, water supply overflow, freezing of overflowed water in the refrigerator, and leakage of overflowed water from the refrigerator can be prevented.

Furthermore, although different amounts of water remain in the ice recesses of the tray, water can be supplied to the ice recesses at an equal level.

Moreover, when water is not supplied to the tray due to malfunctioning of a water supply valve, such a situation can be immediately detected for reducing unnecessary power consumption.

In addition, the ice making assembly can detect the level of water using existing components without the need for an additional device. This reduces the manufacturing costs of the ice making assembly.

The details of one or more embodiments are set forth in the accompanying drawings and the description below. Other features will be apparent from the description and drawings, and from the claims.

DETAILED DESCRIPTION OF THE EMBODIMENTS

Hereinafter, an ice making assembly for a refrigerator will be described in detail according to the disclosed exemplary embodiments of the present disclosure with reference to the accompanying drawings.

In the following description, an ice making assembly is mounted at a freezer compartment door. However, the ice making assembly can be mounted at other places such as a freezer compartment, a refrigerator compartment, and a refrigerator compartment door without departing from the scope of the invention.

Figure 1:
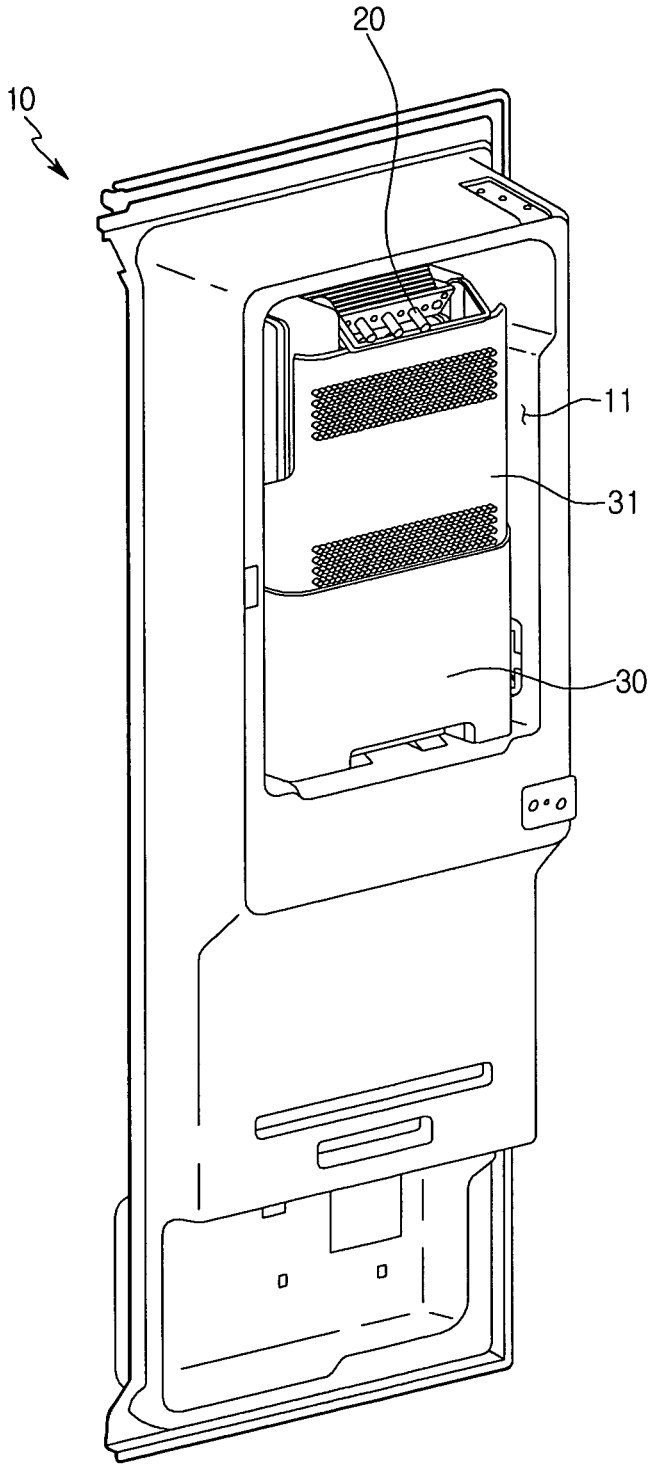
FIGS. 1 and 2 are perspective views illustrating an ice making assembly structure for a refrigerator according to an embodiment of the invention.
Figure 2:
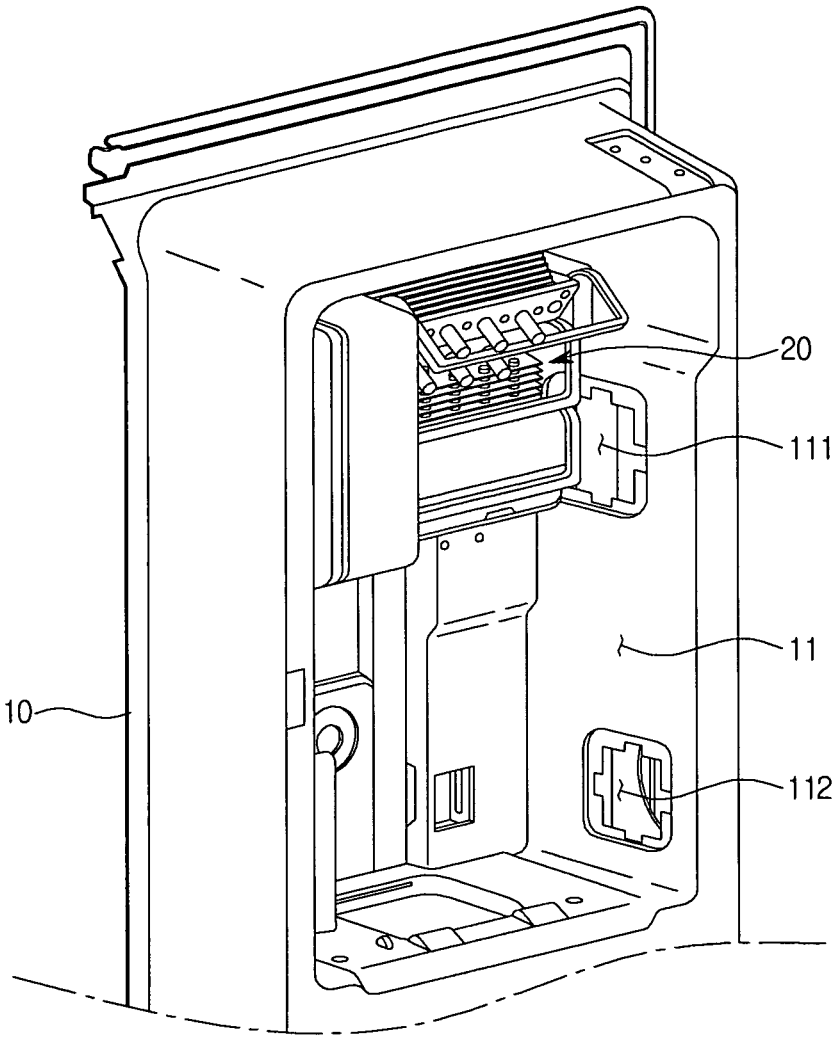

FIGS. 1 and 2 are perspective views illustrating an ice making assembly structure for a refrigerator according to an exemplary embodiment of the invention.

Referring to FIGS. 1 and 2, an ice making assembly 20 may be mounted on the backside of a door 10, and the backside of the door 10 may be recessed to form an ice making space 11 for accommodating the ice making assembly 20. A cooling air supply hole 111 may be formed at a side of the ice making space 11 for allowing inflow of cooling air from an evaporator (not shown), and a cooling air discharge hole 112 may be formed in the side of the ice making space 11 to allow the cooling air from the ice making space 11 to flow back the evaporator.

In detail, the ice making assembly 20 may be mounted at an upper portion of the ice making space 11, and a container 30 may be mounted under the ice making assembly 20 to store ice made by the ice making assembly 20. The ice making assembly 20 may be protected by an ice making cover 31. The ice making cover 31 may also provide guidance for the ice separated from the ice making assembly 20 so that it follows a path directly to the container 30.

Figure 3:
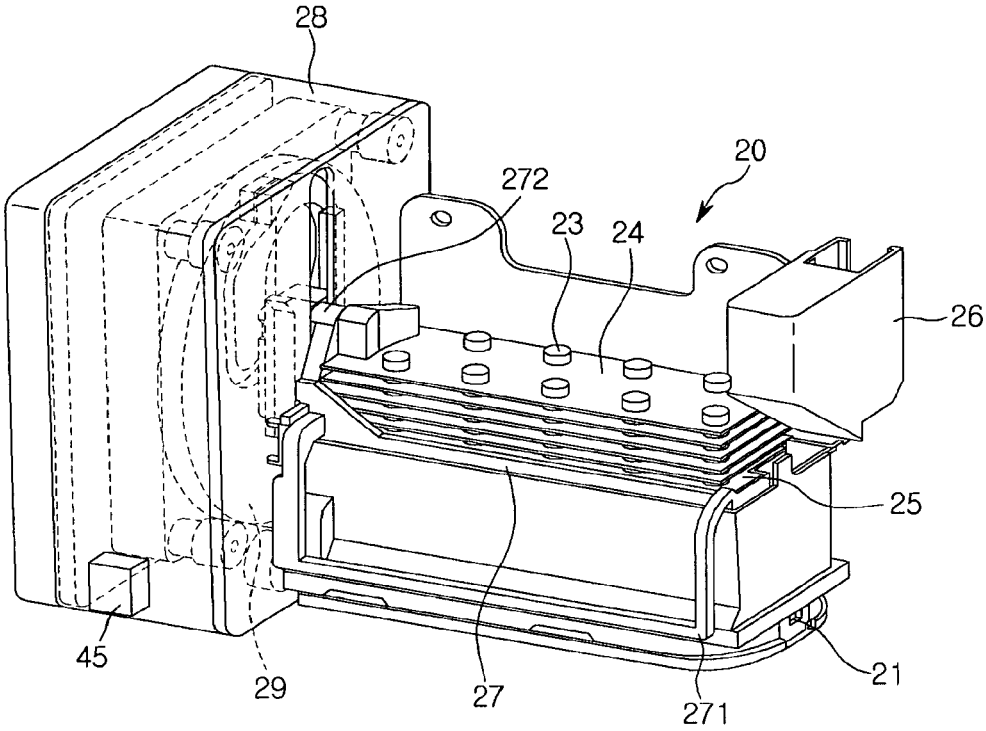
FIG. 3 is a perspective view illustrating an ice making assembly according to an embodiment of the invention.
Figure 4:
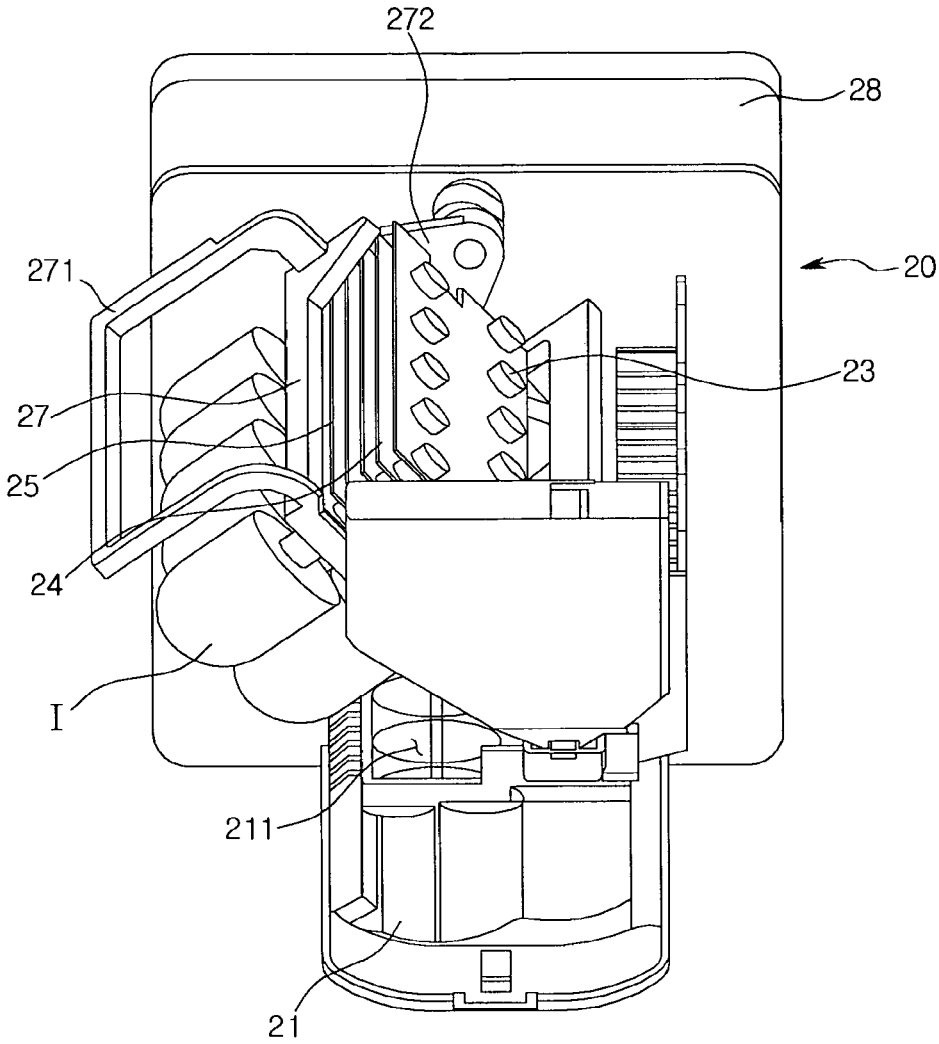
FIG. 4 is a perspective view illustrating the ice making assembly, according to an embodiment of the invention, just before ice is transferred to a container.

FIG. 3 is a perspective view illustrating the ice making assembly 20 according to an embodiment of the invention, and FIG. 4 is a perspective view illustrating the ice making assembly 20, according to an embodiment of the invention, just before ice is transferred to the container 30.

Referring to FIGS. 3 and 4, the ice making assembly 20 of the current embodiment may include: a tray 21 having a plurality of ice recesses 211 for making ice in a predetermined shape; a plurality of fins 24 stacked above the tray 21 and capable of vertical and rotational movement; a plurality of rods 23 configured to be inserted into the ice recesses 211 through the fins 24; an ice ejecting heater 25 provided at the lowermost of the plurality of fins 24; a supporting plate 27 configured to support the ice ejecting heater 25, the remainder of the plurality of fins 24, and the rods 23 as one unit; a water supply part 26 disposed at an end of the tray 21; and a control box 28 disposed at another other end of the tray 21. A heater (not shown) may be mounted at the bottom of the tray 21 to maintain the temperature of the tray 21 at a temperature above freezing. A supporting lever 271 may extend from a front end of the supporting plate 27, and a hinge 272 may be disposed at an end of the supporting plate 27. During an ice making operation, as shown in FIG. 4, ice cubes (I) having a shape corresponding to the shape of the ice recesses 211 may be formed around the rods 23.

A cam 29 and a driving motor may be disposed inside the control box 28. The driving motor may drive a rotational movement of the cam 29. The hinge 272 is coupled to the cam 29 so that the hinge 272 can be used and rotated by rotating the cam 29. The ice ejecting heater 25 may have a plate-like shape and may contact the rods 23. Alternatively, the ice ejecting heater 25 may be embedded within the rods 23. The supporting plate 27 may act to close an open-top of the tray 21 (FIG. 3) such that water supplied to the tray 21 is indirectly cooled by cooling air supplied to the ice making space 11 and flowing about the fins 24 and rods 23.

Hereinafter, ice making and ice ejecting operations of the ice making assembly 20 will be described.

First, the heater attached to the tray 21 may be operated to maintain the tray 21 at a temperature higher than 0° C., to create an environment that can make transparent ice in the ice making assembly 20.

When water is rapidly frozen by cooling air supplied from an evaporator, air dissolved in the water cannot escape from the water before it is frozen. Thus, when water is frozen together with the gas that is trapped inside the water, the resulting ice is not transparent.

However, in the ice making assembly 20 of the disclosed exemplary embodiments, the tray 21 may be maintained at a temperature above freezing so that the water freezes slowly, starting at the freezing rod 23. The air in the water is then able to escape before the water is completely frozen. Thus, transparent ice, which is preferred by the user, may be produced.

According to one embodiment, either before or after water is supplied to the tray 21, the rods 23 may be inserted into the ice recesses 211 of the tray 21, and a freezing operation may be started. In general, the freezing operation may be started after a predefined volume of water is added to the tray 21. The freezing operation may be started by supplying cooling air to the ice making space 11. The temperature of the fins 24 may then be reduced to below the freezing temperature by conduction heat transfer with the supplied cooling air. The temperature of the rods 23 may also be reduced to below the freezing temperature by conduction heat transfer with the fins 24. Portions of the rods 23 inserted in the ice recesses 211 are submerged in the water. Therefore, the water is gradually frozen starting from a region closest to the rods 23. As the water freezes, the frozen region becomes attached to the rods 23. The freezing of the water then proceeds outwardly from the outer surfaces of the rods 23 to the inner surfaces of the ice recesses 211.

After the freezing of the water is completed, the cam 29 may be rotated to move the rods 23, and the ice cubes formed thereon, out of the ice recesses 211. That is, the cam 29 is rotated to lift the rods 23 vertically upward, thus the formed ice cubes (I) may be completely removed from the ice recesses 211. The cam 29 may be further rotated to tilt the rods 23 to a predetermined angle.

The completion of the freezing of the water may be determined by the passage of a predetermined amount of time. More specifically, if a predetermined time passes after the start of the freezing of the water, this may determine that the freezing is completed.

Another method of determining the completion of freezing, involves lifting rods 23, via cam 29, to a predetermined height after a predetermined time from the start of freezing. The predetermined height may be a height at which ice attached to the rods 23 is not yet fully separated from the ice recesses 211. Once the rods 23 are lifted, the amount of water remaining in the ice recesses may be detected. In one embodiment, the amount of water remaining in the ice recesses 211 may be detected using a water level sensor mounted on the tray 21. If the amount of water remaining in the ice recesses 211 is equal to or less than a predetermined amount, it may be determined that the freezing is completed. On the other hand, if the amount of water remaining in the ice recesses 211 is greater than the predetermined amount, the rods 23 may be moved down to their original positions to continue the freezing of the water. The water sensor will be described later with reference to the accompanying drawings. As described above, after the freezing of the water is completed, the cam 29 may be rotated such that it moves the rods 23 vertically upward out of the ice recesses 211. After ice cubes (I) are completely removed from the ice recesses 211, the cam 29 is further rotated to effect rotation of the rods 23. More specifically, the hinge 272 is rotated by the cam 29 to rotate the rods 23 to a predetermined angle.

Once the rods 23 are rotated to the predetermined angle, such as the angle shown in FIG. 4, the ice ejecting heater 25 may be operated.

When the ice ejecting heater 25 is operated, the temperature of the rods 23 increases, and thus the ice cubes (I) are separated from the rods 23. The separated ice cubes (I) may then fall into the container 30.

Figure 5:
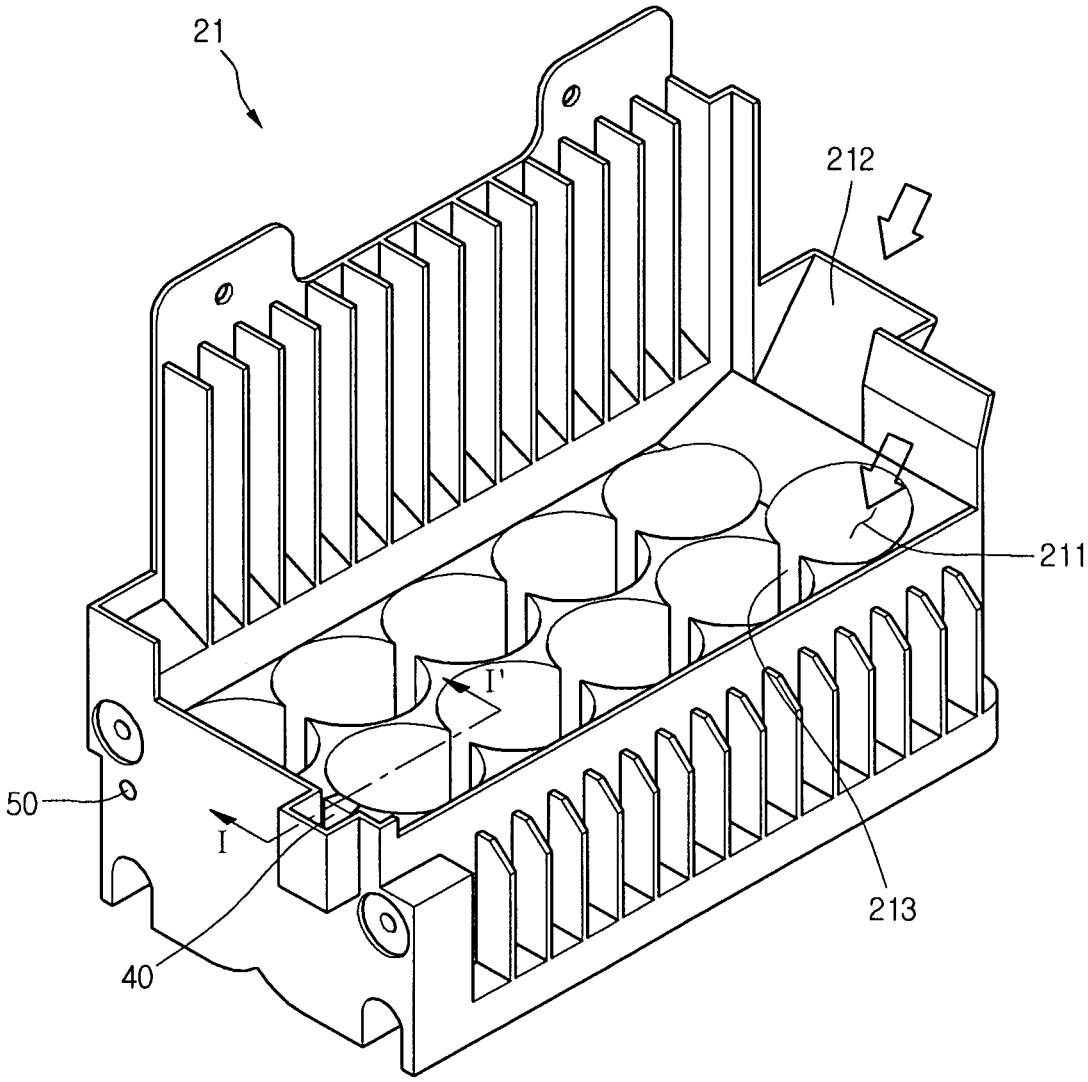
FIG. 5 is a perspective view illustrating a tray of the ice making assembly according to an embodiment of the invention.

FIG. 5 is a perspective view illustrating the tray 21 of the ice making assembly 20 according to an embodiment of the invention.

As illustrated in FIG. 5, the ice recesses 211 may be arranged in the tray 21 of the ice making assembly 20. Channels 213 having a predetermined depth may be formed between the ice recesses 211.

Water can travel between neighboring ice recesses 211 through the channels 213. Bottoms of the channels 213 are spaced apart from bottoms of the ice recesses 211.

A guide 212 may be formed at an end portion of the tray 21 to guide water supplied from the water supply part 26 to the tray 21 and to the ice recesses 211. Water may be supplied to the ice recesses 211 closest to the guide 212 and may gradually travels to the ice recess 211 farthest from the guide 212.

A water level sensor 40 may be mounted at a side of the ice recess 211 farthest from the guide 212, e.g., at a side of the ice recess located at an end of the tray 21 opposite to the guide 212. Further, a temperature sensor 50 may be mounted at a side of the tray 21 and may be used in conjunction with a subassembly to maintain the tray 21 at a constant temperature. A tray heater (not shown) may be installed at the tray 21. The tray heater may be installed at the tray 21 in an embedded manner or attached manner.

Figure 6:
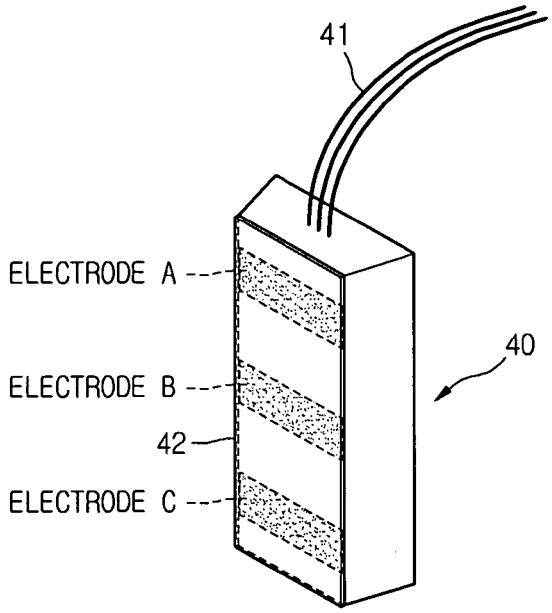
FIG. 6 is a perspective view illustrating a water level sensor of the ice making assembly according to an embodiment of the invention.

FIG. 6 is a perspective view illustrating the water level sensor 40 of the ice making assembly 20 according to an embodiment of the invention.

Referring to FIG. 6, the water level sensor 40 provided at the ice making assembly 20 according to an embodiment of the present disclosure may be mounted at the side of the ice recess 211 as described above. The water level sensor 40 is a capacitive sensor capable of detecting the existence of an object by sensing the capacitance of the object using multiple electrodes disposed at a side of the object. The capacitance water level sensor 40 is a more reliable method of detecting water levels as it is not subject to instantaneous, temporary water level changes, for example caused by opening and closing the refrigerator door housing the ice making device.

In the disclosed embodiment electrodes are provided at a side of ice recess 211 so that the level of water supplied to the tray 21 can be detected using the water level sensor 40. In more detail, as illustrated in FIG. 6, the water level sensor 40, of the exemplary embodiment, includes a plurality of electrodes, and output terminals 41. The output terminals 41 may extend from the electrodes and may connect to the control unit 45, which may be a control unit for operation of the refrigerator in general. The plurality of electrodes are covered with a waterproof layer 42 (FIGS. 6 and 7) so that water cannot function as a conductor having resistance between the electrodes. Hereinafter, an explanation will be given of an exemplary embodiment where the water level sensor 40 includes three electrodes.

In detail, the water level sensor 40 includes an upper electrode A, a middle electrode B, and a lower electrode C. When the water level sensor 40 is attached to the tray 21, the electrode A may be located at a position slightly lower than the highest water level of the ice recess 211, and the electrode C may be located at a position higher than the bottom of the ice recess 211. For example, the electrode C may be located at the same height as the bottom of the channel 213, which is the channel through which water can flow from one ice recess to a neighboring ice recess. As described above, the electrodes A, B, and C cannot make direct contact with water due to the waterproof layer 42. Electrode C is grounded, and an electric charge can be stored between the electrodes B and C or the electrodes A and C according to the level of water.

Figure 7:
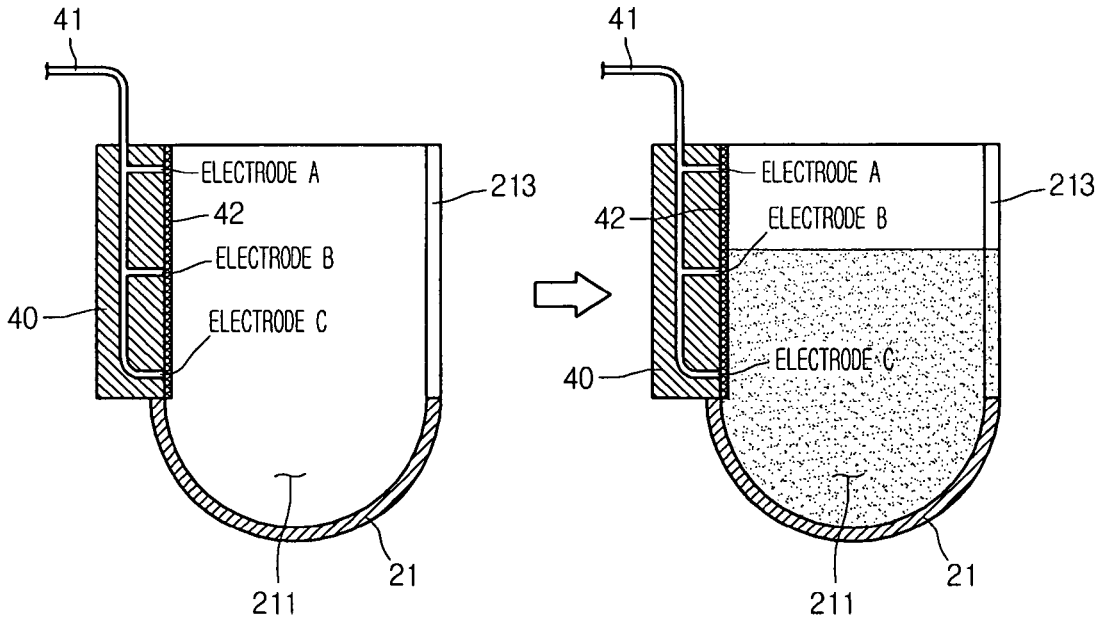
FIG. 7 is a sectional view taken along line I-I' of FIG. 5 for illustrating the increasing level of water supplied to the tray of the ice making assembly according to an embodiment of the invention.
Figure 8:
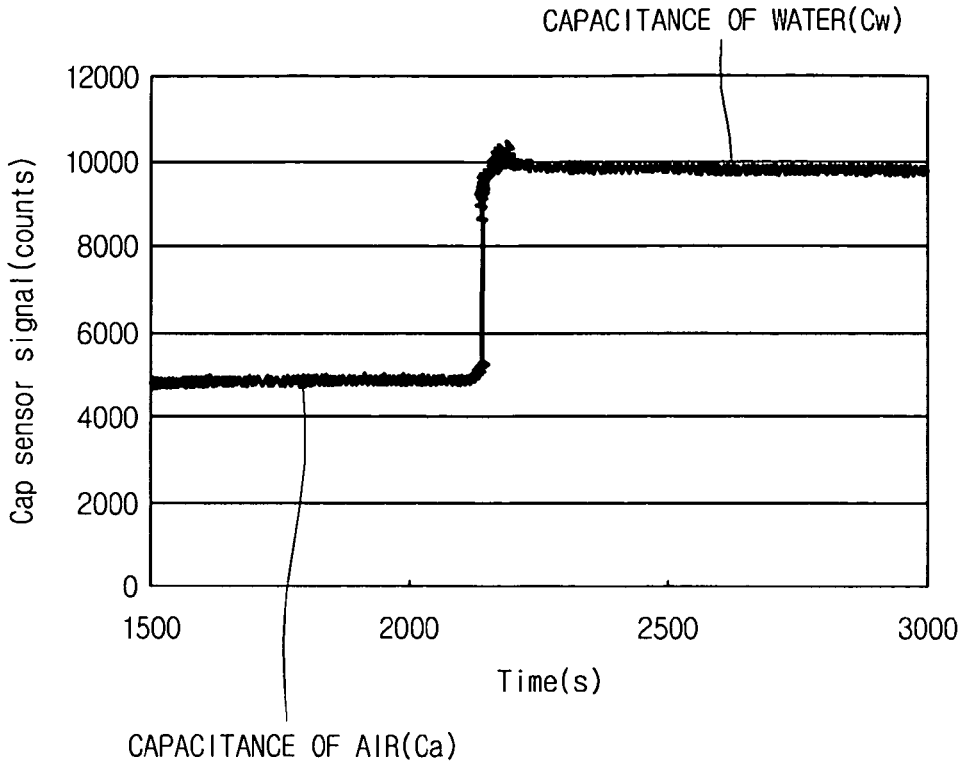
FIG. 8 is a graph illustrating variations of circuit capacitance with respect to the level of water in the ice making assembly of FIG. 7.

FIG. 7 is a sectional view taken along line I-I' of FIG. 5 for illustrating the increasing level of water supplied to the tray of the ice making assembly according to an embodiment of the invention, and FIG. 8 is a graph illustrating variations of circuit capacitance with respect to the level of water in the ice making assembly of FIG. 7. Referring to FIGS. 7 and 8, when the ice recess 211 of the tray 21 is not filled with water, the capacitance between electrodes A and C or electrodes B and C is the capacitance (Ca) of air. In this state, no signal is transmitted to the control unit 45 through the output terminals 41. Similarly, when the level of water in the ice recess 211 is between the electrodes B and C, no signal is transmitted to the control unit 45 through the output terminals 41 because the electrode C is grounded and the water level has not yet reached electrode B.

As water is supplied to the tray 21 and the water in ice recess 211 reaches electrode B, the capacitance between the electrodes B and C changes. That is, the capacitance between the electrodes B and C changes from the capacitance Ca of air to the capacitance (Cw) of water. Accordingly, a sensor signal is sent to the control unit 45 through the output terminal 41 of the electrode B.

As shown FIG. 8, since the capacitance Cw of water is greater than the capacitance Ca of air, the capacitance between the electrodes B and C will change when the level of water reaches the height of the electrode B. Then, the control unit 45 detects the variation of the capacitance and determines that the level of water has reached the height of the electrode B.

If the level of water further increases to the height of electrode A, the capacitance between electrodes A and C will change, similar to the change described above with respect to electrodes B and C. That is, the medium between electrodes A and C changes from air to water, and thus the capacitance between electrodes A and C changes. A sensor signal corresponding to the capacitance change is sent to the control unit 45 through the output terminal 41 (connected to the electrode A). The control unit 45 thus may determine that the level of water has reached the height of electrode A.

FIGS. 9 to 12 illustrate water level variations of the tray 21 of the ice making assembly 20 when water is supplied to the tray 21. For ease of illustration, rods 23 are not depicted in FIGS. 9 to 12. It will be understood, depending on whether water is added before or after rods 23 are inserted into the ice recesses 211, that the displacement of water attributable to the rods 23 may be considered in determining the positioning of electrodes A, B, and C.

Figure 9:
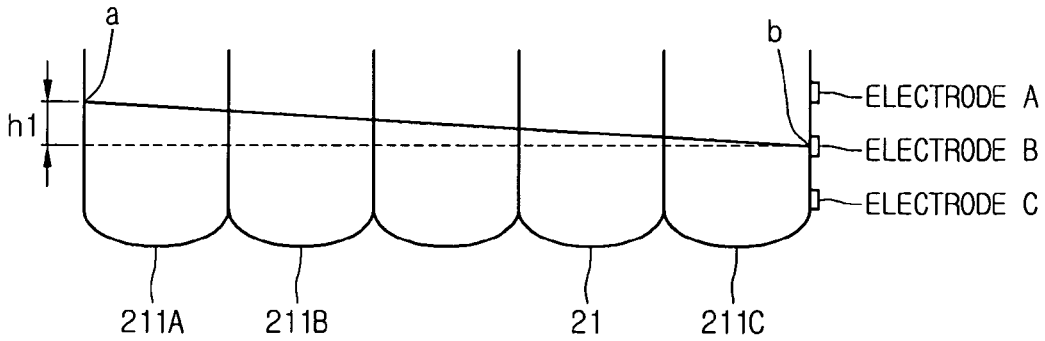
FIGS. 9 to 12 are views for illustrating variations of the level of water supplied to the tray of the ice making assembly according to an embodiment of the invention.

Referring to FIG. 9, after a predetermined amount of time has passed after the water supply has begun, the level of water in the tray 21 at a side of the tray 21 adjacent the guide 212 is different from a water level at a side of the tray 21 opposite to the guide 212.

In more detail, water is first filled in the ice recess 211A closest to the guide 212. When the level of water in the closest ice recess 211A exceeds the bottom of the channel 213, the supplied water then travels to the adjacent ice recess 211B. However, a large amount of water is not transferred to the neighboring ice recesses all at once due to the narrow width of the channel 213 and the surface tension of the water. Therefore, at the beginning of the water supply, the level of water in the ice recess 211A closest to the guide 212 is considerably different from the level of water in the ice recess 211C, which is where the water level sensor 40 is installed. The ice recess 211C maybe the ice recess farthest from the guide 212.

As illustrated in FIG. 9, at the moment when the level of water is detected at electrode B, the level (a) of water in the ice recess 211A, differs greatly from the level (b) of water in the ice recess 211C (h1=a−b, where h1 is the water level difference). While the water is being supplied, the level of water may slope as illustrated in FIG. 9.

Given this level difference during water supply, if the water is continuously supplied until it is detected that the ice recess 211C is filled, oversupply and overflow of at least ice recess 211A may result. More specifically, if the water supply is stopped only when a full water level is detected in ice recess 211C, the stabilized final water level may exceed the full water level in ice recesses closer to the guide 212 (such as ice recess 211A) and cause overflowing of water from the ice tray 21. This is because the water being supplied to ice recess 211A from guide 212 does not immediately transfer to the farthest ice recess 211C. Therefore, to prevent overflow, the water supply is temporarily stopped after water is supplied for a predetermined amount of time sufficient to fill ice recess 211C to the level of the electrode B.

Figure 10:
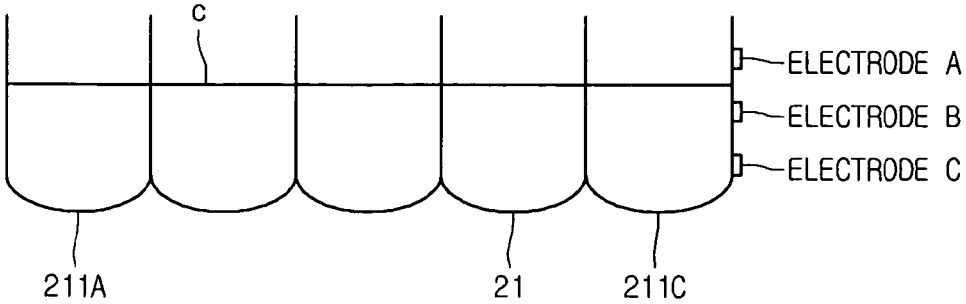

Referring to FIG. 10, when the level of water is detected through the electrode B, the water supply is temporarily interrupted. The water level is then stabilized at a level (c) for a predetermined time. In the exemplary illustration of FIG. 10, the stabilized water level (c) is higher than the height of the electrode B yet lower than the height of electrode A. The predetermined amount of time that the water supply is stopped may be adjusted according to the pressure of water and the size of the channel 213.

Figure 11:
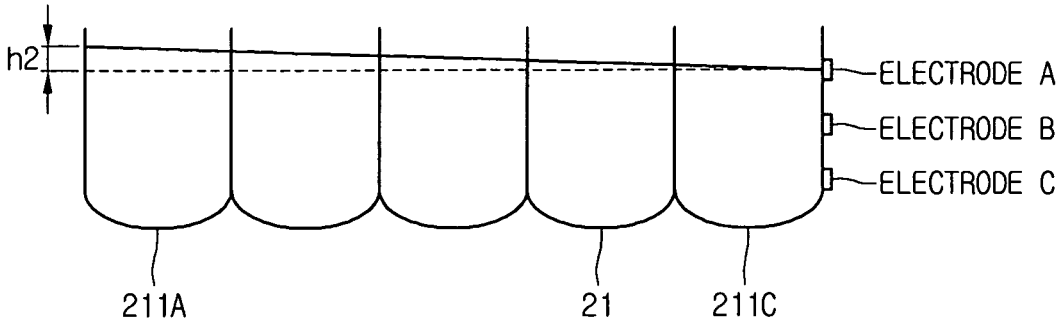

Referring to FIG. 11, if water is supplied again after the predetermined amount of time has passed, the level of water changes to result in a water level difference h2 between ice recess 211A, closest to guide 212, and ice recess 211C, farthest from guide 212.

However, in this example, the water level difference h2 is not as large as the initial water level difference h1 because water is re-supplied after the level of water has increased to some degree. That is, since the intermediate water level h1 is somewhat higher than the bottom of the channel 213, the water travels between all ice recesses, 211A through 211C, more smoothly than it did in the earlier stage of water supply. In addition, the influence of surface tension of water is less as compared with the earlier stage of water supply.

After a predetermined amount of time has passed from the start of the re-supply of water, the increasing water level is detected at the electrode A. Then, the supply of water is suspended again to stabilize the water level.

Figure 12:
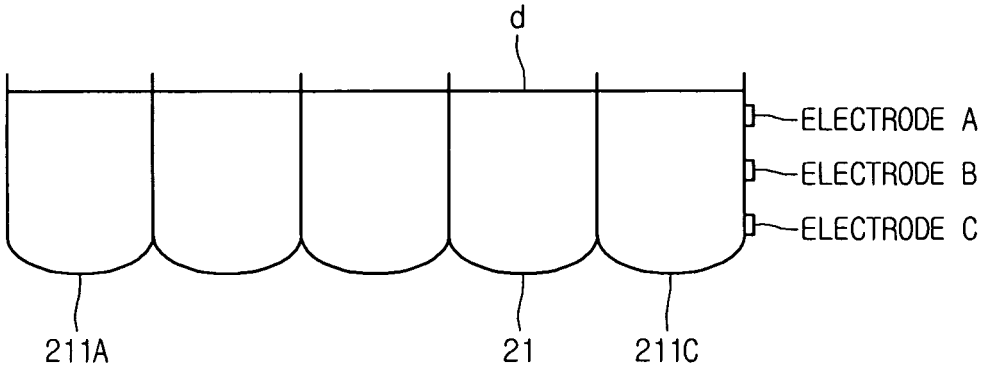

As shown in FIG. 12, the stabilized final water level (d) is higher than the height of the electrode A.

Therefore, by placing the electrode A at a position slightly lower than a full water level, overflowing can be prevented at the end of a water supply operation.

In the above-described embodiments, at least two electrodes may be used to detect a capacitance variation between the two electrodes and suspend a supply of water at an intermediate water level. The water supply suspending time may be shortened or extended depending to the position of the electrode B. In the exemplary embodiments and illustrations just described, the spacing between electrodes C and B appears to be equal to the spacing between electrodes A and B; however, the spacing need not be equal. It is within the scope of the invention to adjust the position of, and spacing between, electrodes A, B, and C. The electrodes may thus be spaced apart at regular or irregular intervals.

In addition, the amount of water remaining after an ice making operation is complete is determined by the position of electrode B. More specifically, according to an embodiment of the present disclosure, the rod 23 may be slightly lifted after a predetermined amount of time has passed from the start of an ice making operation so as to detect the amount of remaining water. If the amount of remaining water is equal to or smaller than a set amount, it is determined that ice is completely made, and the ice is ejected. If the amount of remaining water is greater than the set amount, the rod 23 is moved down to continue the ice making operation.

Thus, the amount of remaining water is determined by the position of the electrode B. If the level of water in the ice recesses 211 is lower than the height of the electrode B, the control unit 45 will determine that there is no water in the ice recess 211, because the control unit 45 cannot detect a capacitance variation. That is, as the position of the electrode B becomes lower, the amount of remaining water will be reduced, and as the amount of remaining water is reduced, the size of ice pieces will increase.

As described above, by using the capacitive sensor 40 capable of sensing capacitance variations, the level of water can be precisely detected, and by supplying water in multiple steps, overflowing of supplied water can be prevented.

In addition, if a capacitance variation is not detected after a predetermined amount of time passes after the start of a water supply operation, it may be determined that there is a water supply error. Thus, the supply of cooling air may be suspended to reduce unnecessary power consumption.

Although embodiments have been described with reference to a number of illustrative embodiments thereof, it should be understood that numerous other modifications and embodiments could be devised by those skilled in the art that will fall within the spirit and scope of the principles of this disclosure. More particularly, various variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

What is claimed is:

1. An ice making assembly for a refrigerator, comprising: a tray comprising a plurality of ice recesses ready to receive a supply of water to be frozen; a plurality of fins disposed above the tray; a plurality of rods inserted through the fins and at least partially received in the plurality of ice recesses, wherein the plurality of fins and plurality of rods move vertically and rotationally as a unit after the supply of water is frozen; a water level sensor disposed in at least one of the plurality of ice recesses; and a motor unit vertically lifting the plurality of fins and the plurality of rods in a state where the plurality of fins are horizontally maintained and ice attached to each rod is spaced apart from a top side of the ice recess, and rotating the plurality of fins and the plurality of rods to a predetermined angle after being lifted, while the tray stays immovable; wherein the motor unit comprises a driving motor and a cam, and the driving motor causes the cam to vertically move the plurality of rods out of the ice recesses and causes the cam to rotate the plurality of fins and the plurality of rods to the predetermined angle.

2. The ice making assembly according to claim 1, wherein the water level sensor is a capacitive sensor that detects the presence of water by measuring a capacitance between at least two electrodes, wherein a first water level is represented by a first measured value of capacitance between the at least two electrodes and a second water level is represented by a second measured value of capacitance between the at least two electrodes, different from the first measured value.

3. The ice making assembly according to claim 2, wherein the first measured value of capacitance is less than the second measured value of capacitance.

4. The ice making assembly according to claim 2, wherein the first measured value of capacitance is substantially equal to the capacitance of air and the second measured value of capacitance is substantially equal to the capacitance of water.

5. The ice making assembly according to claim 2, wherein the water level sensor sends a signal to a control unit when the measured value of capacitance between the at least two electrodes changes by more than a predetermined amount.

6. The ice making assembly according to claim 1, wherein the water level sensor is disposed at a side of an ice recess farthest from a point where water is supplied to the tray.

7. The ice making assembly according to claim 1, wherein the tray further comprises an opening penetrating a common wall between two adjacent ice recesses, to permit the supply of water to flow from a first of the two adjacent ice recesses to a second of the two adjacent ice recesses, wherein the first ice recess is closer to the supply of water than the second ice recess.

8. The ice making assembly according to claim 1, wherein the water level sensor comprises:

a plurality of electrodes including an ground electrode, wherein the plurality of electrodes are vertically arranged at predetermined intervals; and a waterproof layer preventing contact between the plurality of electrodes and any water in the ice recess.

9. The ice making assembly according to claim 1, wherein the plurality of fins are cooled by convection as cooled air is circulated about the fins, and the plurality of rods are cooled to below the freezing point of water by conduction with the fins.

10. The ice making assembly according to claim 1, further comprising:

a supporting plate configured to support the plurality of fins and the plurality of rods as one unit; and a supporting lever extending from an end of the supporting plate.

11. The ice making assembly according to claim 1, wherein at least one of the fins is an ice ejecting heater.

12. The ice making assembly according to claim 1, wherein a heater is embedded within the rods.

13. The ice making assembly according to claim 1, wherein a heater is embedded within the tray or attached to a surface of the tray.

14. The ice making assembly according to claim 1, wherein the water level senor comprises:

a ground electrode disposed at or above a bottom of the ice recess;

a first electrode disposed at a position upward from the ground electrode, the first electrode configured to detect an intermediate water level; and a second electrode disposed at a position upward from the first electrode, the second electrode configured to detect a full water level.

15. The ice making assembly of claim 14, wherein the second electrode is disposed lower than a predetermined full water level.

16. The ice making assembly according to claim 14, wherein a size of ice cubes made by the ice making assembly is dependent on a water level determined by a distance between the ground electrode and the first electrode.

17. The ice making assembly according to claim 1, wherein the water level sensor detects an amount of water remaining in at least one ice recess and the motor unit rotates the plurality of fins and the plurality of rods to the predetermined angle if the amount of water remaining in the at least one ice recess is equal to or less than a predetermined amount.

18. A method for controlling an ice making assembly of a refrigerator, wherein the ice-making assembly includes a tray comprising a plurality of ice recesses, a plurality of rods corresponding to the plurality of ice recesses and disposed vertically at an upper side of the tray above the plurality of ice recesses, and a water level sensor including an upper electrode, a middle electrode, and a ground electrode, the method comprising:

lowering the plurality of rods into their corresponding plurality of recesses;

supplying water to the tray;

determining a first level of the water in the tray by detecting a change in capacitance, as measured between the middle electrode and the ground electrode;

stopping the supplying water when the change in capacitance is detected as measured between the middle electrode and the ground electrode;

waiting a first predetermined amount of time after supplying water is stopped so that a water level in the tray is stabilized;

resuming the supplying water after the first predetermined amount of time passes;

determining a second level of the water in the tray by detecting a change in capacitance, as measured between upper electrode and the ground electrode;

stopping the supplying water when the change in capacitance is detected as measured between upper electrode and the ground electrode; and freezing the water by supplying cooling air to the ice making assembly.

19. The method according to claim 18, further comprising:

transmitting a signal to a control unit through an output terminal of the water level sensor when the change in capacitance is detected.

20. The method according to claim 18, further comprising:

lifting the plurality of rods to a position where a bottom of the plurality of rods is spaced apart from a top of the plurality of ice recess, after the freezing of the water is competed and ice is formed at ends of the plurality of rods;

rotating the plurality of rods by a predetermined angle; and heating the plurality of rods to separate ice from the plurality of rods.

* * * * *